United States Patent [19]

Kellner

[11] Patent Number: 4,689,984

[45] Date of Patent: Sep. 1, 1987

[54] METHOD FOR PRODUCING MALE CONICAL THREADS

[76] Inventor: Urs Kellner, Hüttenackerstrasse 10, CH-8712 Stäfa, Switzerland

[21] Appl. No.: 812,275

[22] Filed: Dec. 23, 1985

[30] Foreign Application Priority Data

Jan. 10, 1985 [CH] Switzerland ..... 103/85

[51] Int. Cl.[4] ..... B21K 1/56

[52] U.S. Cl. ..... 72/402; 10/4; 10/152 R

[58] Field of Search ..... 72/402, 76, 103, 104; 10/152 R, 153, 96 T, 4, 9

[56] References Cited

U.S. PATENT DOCUMENTS

| | | | |
|---|---|---|---|
| 228,033 | 5/1880 | Burke | 10/153 |
| 408,294 | 8/1889 | Dayton | 10/153 |
| 2,583,094 | 1/1952 | Girz | 10/96 T |
| 2,652,577 | 9/1953 | Chiaberta | 10/2 |
| 2,666,348 | 1/1954 | Trishman | 72/103 |
| 2,999,405 | 9/1961 | Ewart | 72/402 |
| 3,056,197 | 10/1962 | Lawson | 10/153 |
| 3,154,978 | 11/1964 | Warwick | 78/15 |
| 3,370,451 | 2/1968 | Schuetz | 72/402 |
| 3,381,515 | 5/1968 | Orloff | 72/354 |
| 3,417,598 | 12/1968 | Valente | 72/402 |
| 3,850,535 | 11/1974 | Howlett et al. | 403/305 |
| 3,999,417 | 12/1976 | Orain | 72/356 |

FOREIGN PATENT DOCUMENTS

| | | | |
|---|---|---|---|
| 805033 | 5/1951 | Fed. Rep. of Germany . | |
| 621432 | 8/1978 | U.S.S.R. | 10/152 R |
| 664727 | 5/1979 | U.S.S.R. | 72/104 |

*Primary Examiner*—Daniel C. Crane

*Attorney, Agent, or Firm*—Handal & Morofsky

[57] ABSTRACT

A male conical thread of an elongated steel structure, e.g. a steel rod or wire of the type employed as reinforcement in pre-stressed concrete, for use in engagement with a matching female conical thread provided in a fixing sleeve or other nut means is formed by first shaping an end portion of the wire or rod, e.g. by grinding or hammering, into a cone that tapers down towards the end of the rod or wire and has a generally truncated smooth outer surface; then, the cone's surface is deformed by cold-pressing such that the thread is formed. Further, a press-die appartus is disclosed for use in such cold-pressing, e.g. at a construction site where steel reinforcements are mounted.

8 Claims, 4 Drawing Figures

METHOD FOR PRODUCING MALE CONICAL THREADS

BACKGROUND OF THE INVENTION

1. Field of the Invention

The invention relates to metal working and, specifically, to a method and apparatus for producing external conical threads at end portions of steel rods or wire of the type used as reinforcements in pre-stressed concrete structures.

2. Prior Art of the Invention

Tapered thread connections are known to provide for quick engagement of multi-threaded male and female connector portions since as few as one or two turns may be sufficient for complete and firm engagement of a large number of threads of both the male and the female part of the thread connection.

Hence, conical threads are particularly suitable as fastening threads when, during tightening, the threaded bolt and/or the threaded nut can be turned only with great effort, or should not be displaced much in axial direction. A well-known use of conical threads is for physical connection or "splicing" of steel reinforcements in pre-stressed concrete by providing the ends of the reinforcing rods or wires with male, i.e. external, conical threads and connecting ends of such reinforcements by means of end pieces, connectors, or nuts each having at least one female, i.e. internal, conical threads, e.g. a connector nut having two such female threads at opposing ends. Such connectors are disclosed, for example, in U.S. Pat. Nos. 3,415,522 and 3,850,535 and are sold commercially by Fox-Howlett Industries of Berkley, Cal.

According to the art, male conical threads at the ends of steel reinforcements are produced by cutting with a thread cutting apparatus having two mutually opposed chasers displaceable in radial direction. An example of such an apparatus is disclosed in European Published Application No. 97 745 (Erico Product, Inc.).

However, thread cutting is known to reduce the strength of a metal structure because the grain structure, structural continuity, or grain flow will be interrupted by a cut thread, and because a notch effect will occur in the core area of the thread's undercut so as to reduce the load-bearing cross-section of the thread. A further disadvantage of prior art thread cutting for producing tapered threads is that it requires great skill, a rather delicate apparatus, and too much time.

Generally, prior art thread-forming methods by non-cutting techniques may involve pressing or rolling; such methods are limited, however, for practical reasons by the magnitude of the forces required for deformation of the material in which the threads are to be made. For example, while cylindrical threads of good quality have been obtained by cold-rolling of steel rods or wires, such a method can be operated with relatively short rollers only and requires roller displacement in axial direction when longer threads are to be obtained. Evidently, axial roller displacement is not practical when non-cylindrical, i.e. conical, threads are to be made and rolling methods are not assumed to be applicable to normal production of male conical threads on high-tensile steel structures.

For the same reason, cold-pressing of male conical threads is restricted to structures or metals, e.g. aluminum alloys or the like, that are substantially softer than high-tensile steel structures of the type suitable for concrete reinforcement by pre-stressing.

Now, with the substantial and increasing importance of pre-stressing methods in concrete constructions such as bridges, wide-span roofing, or shell structures and the like there is a substantial and increasing need for a simple method and tool that permits to form external tapered threads at a construction site since, while the female connectors are normally factory-produced and supplied to the construction site ready for use, steel wires or rods may not, or not always, be provided ready for use at the construction site taking into account that external threads are sensitive to accidental damage during transportation and handling, and that production of male tapered threads may be required at a construction site because of specific dimensional requirements or the like needs.

Further, prior art tapered male threads produced by thread cutting suffer from all the above-mentioned disadvantages of cut threads, i.e. lower mechanical strength and less corrosion resistance.

OBJECTS OF THE INVENTION

Accordingly, it is a main object of the invention to provide for an improved method of forming an external conical thread on an elongated steel structure of the type used as a reinforcement in pre-stressed concrete constructions.

Another object of the invention is a method for producing an external conical thread on a steel structure in which the thread is formed by a cold-pressing method that avoids the disadvantages of thread-cutting and the problems of cold-rolling and can be carried out with an apparatus that is sufficiently simple and robust for use at a construction site where steel reinforcements for concrete are mounted or assembled.

A further object of the invention is an apparatus capable of producing an external conical thread on an elongated steel structure of the concrete reinforcing type by cold-pressing the steel to form the thread.

Further objects will become apparent as the specification proceeds.

SUMMARY OF THE INVENTION

The above objects and further advantages are achieved, according to a first embodiment of the invention, by a method of forming an external conical thread having a generally tapered outer contour at an end portion of an elongated structure made of steel and comprising the steps of: shaping said end portion, e.g. by cutting or non-cutting methods, into a cone corresponding to said outer contour and having a generally smooth outer surface; and then deforming the cone surface by cold-pressing so as to form said thread.

As will be explained in more detail below such cold-pressing generally is effected according to the invention by applying a segmented or multi-component die in a manner such that the operating force that is applied to move the die segments onto the cone surface for deforming the latter by cold-pressing acts upon the die segments in a direction that is substantially parallel to the longitudinal axis of the cone which, in turn, is preferably co-axial with the longitudinal axis of the elongated steel structure.

The term "conical thread" as used herein is synonymous with the term "tapered thread" while "external" or "internal" thread is used synonymously with "male" or "female" thread, respectively. Further, "reinforcement" as used herein generally refers to that type of concrete reinforcement also called "pre-stressing" where a tensile stress is applied to a construction prior or after casting and setting of the concrete by means of tensioning members made of high-tensile steel and where "interconnection" may be required for connecting or "splicing" two or more tensioning members, or for connecting one tensioning member with a tension-support, end-plate or anchor. "Pre-stressing" also includes the method wherein the stressing of the steel tensioning members is caused by predetermined deformation of a concrete structure.

When operating the inventive method, actual motion of the die segments also termed "open dies" will generally be effected in directions (i.e. one direction for each die segment) that will intersect with the longitudinal cone axis at an acute angle of generally less than 20°, e.g. at a typical angle of 5°–15° (assuming 360° for a full circle).

With this generally preferred embodiment of the invention it is possible to form external conical threads at the end portion of typical concrete-reinforcing steel wires or rods for pre-stressed concrete structures at the point of use, e.g. a construction site, where the ambient conditions would prevent forming of external conical threads on steel by conventional methods.

The term "cold-pressing" as used herein is intended to refer to defomation at a temperature below that where significant softening of the steel occurs; generally, cold-pressing is involved when, starting at an ambient temperature of the blank, any temperature increase of the material is essentially autogeneous. The term "elongated structure made of steel" as used herein is intended to refer to wires, rods, bars and other elongated structures with a typical length: width-ratio of above 10:1 made of a high-tensile iron alloy of the type suitable for reinforcement of concrete, such as typically used in pre-stressed concrete constructions, e.g. Grade 40 and Grade 60 (ASTM A 615-68).

According to a second general embodiment, the invention provides an apparatus for producing an external conical thread of the type just mentioned comprising:

(a) a guide sleeve encompassing an elongated conical inner space;

(b) a plurality of co-acting open dies or die segments arranged within the inner space for primary displacement of the dies in both axial directions of the elongated inner space, each die segment having an inner working surface provided with a profile corresponding to a segment of a nut matching the external conical thread that is to be formed in the steel, and (c) a pressure plate for causing displacement of the die segments in the direction of decreasing diameter of the conical inner space.

Generally, the co-acting die segments are arranged on the pressure plate for secondary displacement in a radial direction.

As used herein, "primary" displacement or motion of the die segments refers to movement in a generally axial direction relative to the cone while "secondary" displacement refers to motion of the die segments in a generally radial direction.

It will be understood, however, that actual movement of the die segments upon thread-pressing according to the invention will be "inclined" relative to the longitudinal axis of the cone and intersect at an acute angle with that axis.

By appropriate selection of the slope of the conical inner space of guide sleeve (a) a strong lever action of typically above about 5:1 can be effected, e.g. having a primary motion of 5 units cause a secondary motion of 1 while the force causing the secondary motion is 5 times greater than the force required to cause the primary motion.

According to a preferred embodiment, each of the die segments has an essentially T-shaped cross-section and the guide sleeve comprises a plurality of longitudinal grooves inclined at a first acute angle ($\alpha$) of less than 20° relative to the longitudinal axis of the inner space of the guide sleeve means for movably holding the die segments.

Preferably, the first inclination angle ($\alpha$) is oppositely inclined relative to a second inclination angle ($\beta$) of the inner working surfaces of the dies.

Typically, ($\alpha$) is greater than ($\beta$) and ($\alpha$) is in the range of from about 5°–15° while ($\beta$) is in the range of from 3°–12°.

Generally, the apparatus additionally comprising a guide means formed by a guide ring, a stop pin, and a screw for detachably securing the guide ring to the elongated steel structure on which the thread is to be made and for contact with the stop pin which, in turn, is secured to the guide sleeve for aligning the elongated steel structure when the thread is pressed into the cone's surface.

According to a further preferred embodiment, the inner working surface of each segment corresponds to a segment of a nut having threads defined by helical flanks that are arranged at substantially equal angles relative to a spiral having a helical surface arranged perpendicularly relative to the axis of the nut, or relative to the conical inner surface of the nut.

The invention in its method and apparatus aspects provides for steel rods or wires having long external conical threads in which the metallurgical surface structure is improved by grain compression rather than deteriorated by cutting providing for a higher load-bearing capacity, an increased corrosion resistance and an improved fatigue strength when compared with prior art tapered threads made of the same material and having the same dimensions but being formed by thread-cutting.

Further, the structure of the inventive apparatus does not need particular external high-pressure generator means and simple compressors will generally be sufficient because of the force leverage effect of the guide sleeve which, as mentioned above, will convert a relatively low specific pressure exerted by the pressure plate in the die segments into a substantially higher specific pressure of the die segments onto the cone surface for cold-pressing deformation thereof.

BRIEF DESCRIPTION OF THE DRAWINGS

The invention will be explained in more detail with reference to the annexed drawings which

DETAILED DISCUSSION OF PREFERRED EMBODIMENTS OF THE INVENTION

First, it should be noted with respect to the Figures that the components of the apparatus are not drawn to scale and that proportions are exaggerated for clarity.

Figure 1:
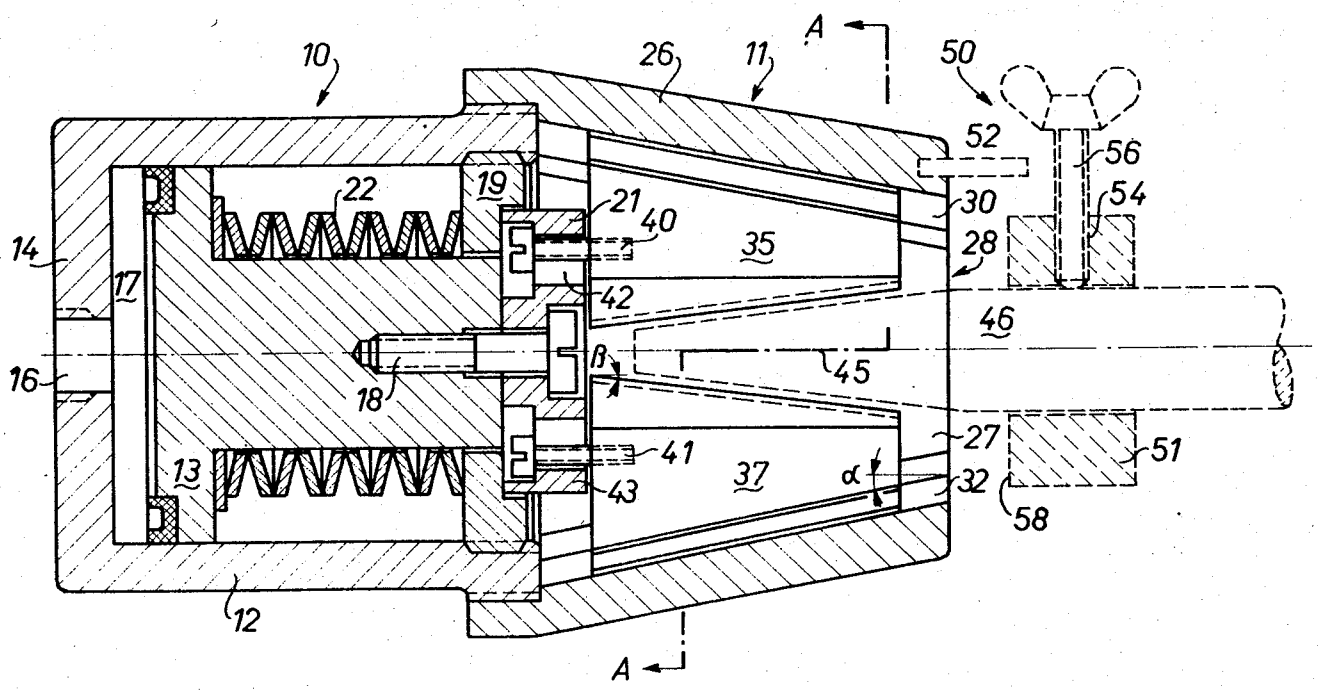
FIG. 1 is a longitudinal sectional view of en embodiment of the inventive apparatus for pressing a conical external thread into a conically pre-shaped workpiece.
Figure 2:
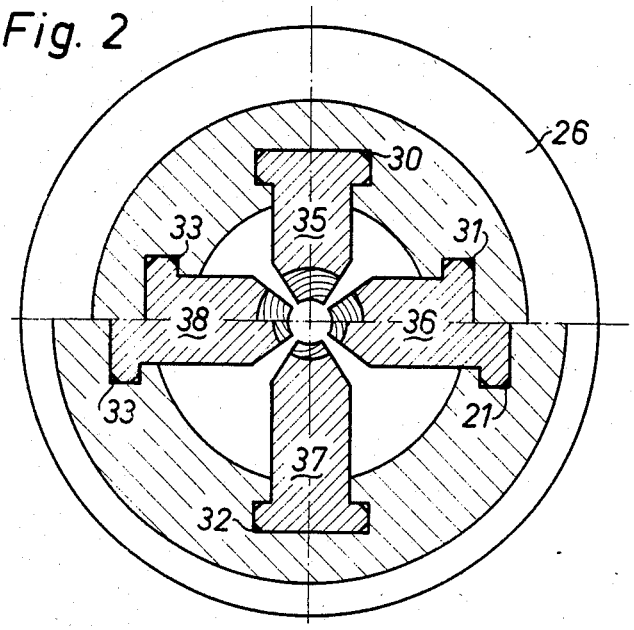
FIG. 2 is the cross-sectional view along line A—A of FIG. 1.

The apparatus shown in longitudinal section in FIG. 1 and cross-section in FIG. 2 comprises a hydraulic press 10 which cooperates with a thread crown 11. The hydraulic press consists of a hydraulic cylinder 12 and a matching piston 13 which is displaceable in axial direction. Bottom 14 of cylinder 12 has a bore or hole 16 for connection to a hydraulic line which connects the inner space 17 of the cylinder to a hydraulic pump. Such hydraulic pumps and lines are well-known in the art and, hence, neither illustrated nor described herein in detail. A piston rod 18 is formed on that surface which faces away from the working surface of the piston 13, the free end of the said rod projecting out of the cylinder, through the central opening of an annular cylinder lid 19. A pressure plate 21, whose diameter is greater than the diameter of the piston rod, is fastened to the free end of the latter. A pressure spring 22 is located around that part of the piston rod which lies inside the cylinder, the free ends of the said spring resting against the rear surface of the piston and the inner surface of the cylinder lid.

The thread crown 11 contains a guide sleeve 26 which is screwed onto the hydraulic press 10 in the region of the cylinder lid 19. The guide sleeve has a conical inner space 27 whose larger diameter or base circle is adjacent to the pressure plate 21, and whose smallest diameter or upper circle forms an openning 28 in the upper surface of the thread crown, this surface facing away from the hydraulic cylinder. Four grooves 30, 31, 32, 33 displaced from one another by 90° and having a T-shaped cross-section are incorporated into the wall of the conical inner space 27. The grooves run parallel to the generators of the conical inner space and are therefore inclined at an angle $\alpha$ to the longitudinal axis 45 of the thread crown.

Four die segments or open dies 35, 36, 37, 38 which are trapezoidal in side-view are arranged in the conical inner space. The open dies have a T-shaped cross-section with a two-armed guide bar and a die projecting from this. The guide bar of each open die is mounted in an allocated groove in the guide sleeve in such a way that it can be displaced along the longitudinal direction of the crown, and is connected to the pressure plate 21 by means of a screw 40, 41. The screws pass through radial slots 42, 43 in the pressure plate in order not to block the displacement in the radial direction, which overlaps each displacement of the open dies in the axial direction. The inner surface of the open dies which face the center of the conical inner space 27 are inclined at an angle $\beta$ to the longitudinal axis 45. The direction of inclination of this angle $\beta$ is opposite to that of the angle $\alpha$, and the angle $\beta$ is smaller than the angle $\alpha$. The inner surfaces of the open dies have an arc-shaped cross-section and have a surface profile which matches a corresponding part of a nut for the conical external thread to be pressed.

In carrying out the method according to the invention, the end of a workpiece which is to be provided with a conical external thread is first provided with a conical shape. This conical shape should of course as far as possible have the same angle $\beta$ as the conical external thread to be produced. The conical shape can be produced by machining, for example by turning or grinding, or by working without cutting, e.g. pressing or hammering. However, care should be taken to ensure that this working does not substantially alter the material properties and in particular the tensile strength and flexural strength, and that the surface does not develope any hairline cracks which may grow into fracture points during subsequent loading of the thread.

Before each use of the apparatus described, the pressure in the hydraulic press 10 is relieved so that the spring 22 pushes the piston 13 back into its rest position until the pressure plate 21 comes into contact with the cylinder lid 19, and the open dies 35, 36, 37, 38 are drawn as far as possible into the conical inner space 27 and, owing to the inclined guide grooves 30, 31, 32, 33, have the greatest possible distance between their inner surfaces. The conical end of a workpiece, for example a steel reinforcement 46, is then passed through the opening 28 of the guide sleeve 26 in the direction of the pressure plate 21 until the conical shape is in contact with the inner surface of the open dies along its entire length. Thereafter, hydraulic fluid is passed into the inner space 17 of the cylinder 12, and pushes the piston 13 in the direction of the cylinder lid 19. The pressure plate 21, together with the piston and the associated piston rod 18, is pushed in the direction of the opening 28 in the guide sleeve 26, and pushes the open dies 35, 36, 37, 38 in the said direction. Because the guide grooves 30, 31, 32, 33 for the open dies are inclined with respect to the axis 45 of the crown, the open dies are simultaneously pushed toward one another in the radial direction during this axial displacement. The inclined plane formed by the guide grooves results in the force acting on the dies in the radial direction being several orders of magnitude greater than the force of the pressure plate 21 acting in the axial direction. During this displacement in the radial direction, the inner surfaces of the die are pressed into the conical end of the steel reinforcement until all part surfaces of the profiled inner surfaces of these dies come into contact with the steel reinforcement, or the lateral edges of inner surface of adjacent dies abut one another.

As soon as the open dies can be pressed together no further in the radial direction (and the displacement in the axial direction also comes to a stop), the pressure of the hydraulic fluid in the inner space 17 of the cylinder 12 is reduced until the spring 22 is able slightly to push back the piston 13 and with it the pressure plate 21. During this backward displacement, the open dies connected to the pressure plate are also drawn back, retraction of the dies in the axial direction simultaneously resulting in the dies being pulled apart in the radial direction. The conical end of the steel reinforcement with the pressed thread is then rotated between the loosened dies in order that any burr thrown up during pressing of the dies into the steel is cut off on the lateral edges of the inner surfaces of the open dies. Finally, the hydraulic fluid is discharged from the inner space of the cylinder so that the spring is able to force the piston with the pressure plate and the connected open dies back into the starting position. The steel reinforcement with the pressed-in conical external thread can then be withdrawn from the apparatus.

When the lateral edges of the inner surfaces of the open dies are unsuitable for cutting off the burr, or a long steel reinforcement cannot be rotated between the retracted open dies, the burr can also simply be pressed into the pressed thread. To do this, the steel reinforcement is rotated about its longitudinal axis between the open dies, which have been retracted in the radial direction, until each burr running in the longitudinal direction and over the entire length of the thread is opposite the inner surface of an open die, after which the open dies are again pushed toward each other in the radial direction. Care should be taken to ensure that the steel reinforcement is inserted between the open dies to the same extent as in the preceeding operation for pressing the thread, and that rotation about the longitudinal axis is relatively small so that the pressed thread is not deformed or damaged during removal of the burr. This is advantageously carried out using the apparatus 50 drawn with a broken line in FIG. 1. This apparatus consists of a guide ring 51, which is to be pushed onto the steel reinforcement 46, and of a stop pin 52, which projects from the front surface of the crown, parallel to the axis. The guide ring has a guide surface 53 and a threaded hole 54 which runs in the radial direction and into which a thumb screw 56 is screwed. When this apparatus is used, the guide sleeve sitting loosely on the steel reinforcement is pushed until its guide surface rests against the open dies, this being carried out after insertion of the steel reinforcement into the crown but prior to pressing off the thread, and the said guide sleeve is then screwed firmly to the steel reinforcement with the aid of the thumb screw. The rotation of the thumb screw with respect to the stop pin, as viewed in the axial direction, should as far as possible be no more than about 10°. After pressing of the thread and retraction of the die, the steel reinforcement is again pushed into the crown until the guide surface again rests against the dies, and at the same time is rotated so that the thumb screw rests against the stop pin. Thereafter, the press is again subjected to pressure, and the open dies are pushed together as described above for pressing the thread. A conical thread pressed twice in this manner does not contain any burr which can be felt, and can be screwed satisfactorily into a nut having a conical internal thread.

Figure 3A:
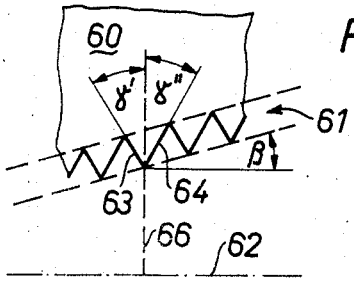
FIG. 3*a* is a diagrammatic sectional view of a thread obtained according to the invention and having flanks that are symmetrical with respect to the central axis of the cone.

FIG. 3*a* shows diagrammatically an axial section through an open die 60 with the thread profile 61 corresponding to a conical nut. The individual threads of the profile are aligned symmetrically with respect to the longitudinal axis 62, i.e. each flank 63 or 64 makes the same angle $\gamma'$ or $\gamma''$ with the plane 66 lying transverse with respect to the longitudinal axis. The figure also shows that the two flanks of each thread are of different lengths, the flank 64 which is to the front in the axial displacement direction during pressing of the thread being longer than the rear flank 63. These different lengths of the flanks correspond to different thread areas and therefore to different pressures on the surface during pressing of a thread.

Figure 3B:
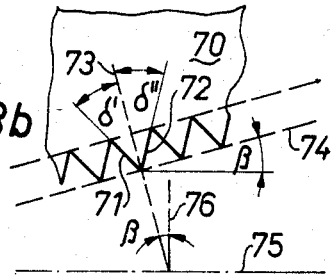
FIG. 3*b* is a diagrammatic sectional view of another thread produced according to the invention and having flanks that are symmetrical with respect to the cone.

In order to avoid this pressure difference and its possible adverse consequences, it may be advantageous to use open dies whose threads are arranged symmetrically with respect to the cone of the inner surface. FIG. 3*b* shows an axial section through such an open die 70. In this die, the threads of the screw have flanks 71, 72 which make equal angles $\delta'$ or $\delta''$ with a straight line 73 which is at right angles to the cone 74 of the inner surface (or is inclined at the cone angle $\beta$ to the straight line 76 at right angles to the longitudinal axis). In this screw, the flanks of the individual threads are of equal length and the pressures acting on the flanks on each thread during pressing of a screw are therefore equal.

In an embodiment of the apparatus described which has been tested in practice, the piston 13 had a diameter of 140 mm and a stroke of 25 mm. The apparatus was connected to a hydraulic pump which generated a pressure of about 700 bar, corresponding to a force per unit area of 900 kN at the piston. The angle $\alpha$ of the generator of the conical inner space 27 was 10°. When, in order to change the direction of the force produced by the hydraulic press from the axial direction to the radial direction, the grooves in the inside of the cone are regarded, for the sake of simplicity, as inclined planes having a slope of 5:1, the force of the open dies which acts in the radial direction is about 5000 kN.

In a tested embodiment, the thread crown contained four open dies. The inner surfaces of these open dies, which were 105 mm long in the axial direction, were inclined at an angle $\beta=7°$ to the axis 45 of the crown, and their profile corresponded to the threads of a rounded V-screw thread having a lead of 2 mm and a depth of 1.5 mm.

The apparatus was used to press a conical thread into a steel reinforcement made of IIIA steel and having a diameter of 40 mm and a yield strength of 5000 kg/cm$^2$, in the course of 5 sec. The thread exhibited only a small burr which did not need to be removed and was not a hindrance when a nut was screwed on. In a ground longitudinal section through the steel, no hairline cracks could be detected in the region of the thread. The embodiment of the apparatus described is relatively light. The weight of the pres and crown is about 35 kg, which very substantially facilitates transport of the apparatus to the work site or installation of the apparatus at the work site.

The apparatus described can of course be modified in a variety of ways and adapted to specific requirements. For example, for pressing conical threads of different diameters, it is advantageous to use exchangeable thread crowns in which the dimensions of the open dies are metched to the dimensions of the thread to be pressed or to the diameter of a steel reinforcement. Furthermore, it may be advantageous to use angles other than those described, both for the guide grooves in the sleeve and for the inner surfaces of the open dies. It is also possible, for example depending on the diameter of the thread to be pressed, to use more, or fewer, than the four open dies described.

The apparatus described can of course be used not only for pressing conical threads in steel reinforcements, for example as described above, but also for pressing such threads into any workpieces prepared in a suitable manner.

What I claim is:

1. A method of forming an external conical thread having a generally tapered outer contour at an end portion of an elongated structure made of steel; said method comprising the steps of:

shaping said end portion into a cone corresponding to said outer contour and having a generally smooth outer surface; and deforming said surface of said cone by cold-pressing so as to form said thread;

said cold-pressing being effected by applying onto said surface a composite die including a plurality of die segments arranged about an axis which in a first or open position are capable of receiving said cone and which move along said axis and radially to said axis to a second or closed position to substantially define an internal conical thread matching said external conical thread; and wherein a force is applied to move said die segments from said open position to said closed position onto said cone surface for deformation thereof; said force acting upon said die segments in a direction substantially parallel to a longitudinal axis of said cone; and wherein each of said segments is guided into said closed position to move in a direction toward said cone surface which direction intersects with said longitudinal axis at an acute angle or below about 20°.

2. In the method of producing an external conical thread having a generally tapered outer contour at an end portion of an elongated steel structure by shaping said end portion into a cone corresponding to said outer contour and having a generally smooth outer surface and by deforming said surface of said cone so as to form said thread; the improvement comprising:

(a) providing a guide sleeve means including a conical inner space having a longitudinal axis;

(b) providing a plurality of dies arranged within said inner space for primary displacement in directions of said longitudinal axis; each of said dies having an inner surface facing said longitudinal axis and a die profile corresponding to a segment of a conical thread that is to be formed at said end portion;

(c) providing a pressure plate means for causing said primary displacement of said dies in a direction of decreasing diameter of said conical inner space along said longitudinal axis; said dies being arranged on said pressure plate means for secondary displacement in a radial direction; and (d) causing said dies to form said external conical thread on said end portion by operating said pressure plate to effect said primary displacement of said plurality of dies within said inner space of said guide sleeve means and said secondary in said radial direction.

3. The method of claim 2 wherein said method comprises providing each of said dies with an essentially T-shaped cross-section and said guide sleeve means with a plurality of grooves extending in a longitudinal direction and being inclined at a first angle ($\alpha$) relative to said longitudinal axis of said inner space of said guide sleeve means and connecting said dies with said grooves for movement along said grooves.

4. The method of claim 3 wherein said grooves are provided said first angle ($\alpha$) oppositely inclined relative to a second angle ($\beta$) of inclination of said inner surfaces of said dies.

5. The method of claim 2 including the additional step of:

(e) providing a guide means with a guide ring, a stop pin, and a screw detachably securing said guide ring to said elongated steel structure and contacting said stop pin which, in turn, is secured to said guide sleeve means for aligning said elongated steel structure when said thread is pressed onto said surface of said cone.

6. The method of claim 2 wherein said inner surface of each of said dies is provided with a shape to correspond to a segment of a nut means having an axis and screw threads defined by helical flanks that are arranged at substantially equal angles relative to a spiral having a helical surface arranged perpendicularly relative to said axis of said nut means.

7. The method of claim 2 wherein said inner surface of each of said dies is provided with a shape to correspond to a segment of a nut means having an conical inner surface with screw threads defined by helical flanks that are arranged at equal angles relative to a spiral having a helical surface arranged perpendicularly relative to said conical inner surface of said nut means.

8. In the method of producing a composite steel reinforcement for use in pre-stressing of concrete constructions by interconnection of at least two tensioning structures made of steel, one of which structures is an elongated wire, rod or bar structure having at least one end provided with a male conical thread, and the other of which tensioning structures is a connector or nut means having at least one end provided with a female conical thread;

the improvement comprising:

(a) providing a guide sleeve means including a conical inner space having a longitudinal axis;

(b) providing a plurality of dies arranged within said inner space for primary displacement in direction of said longitudinal axis; each of said dies having an inner surface facing said longitudinal axis and a die profile corresponding to a segment of a nut means matching said conical thread that is to be formed at said end portion;

(c) providing a pressure plate means for causing said primary displacement of said dies in a direction of decreasing diameter of said conical inner space along said longitudinal axis; said dies being arranged on said pressure plate means for secondary displacement in a radial direction; and (d) causing said dies to form said external conical thread on said end portion by operating said pressure plate to effect said primary displacement of said plurality of dies within said inner space of said guide sleeve means and said secondary in said radial direction.

* * * * *